US005931465A

United States Patent [19]

Miyake et al.

[11] Patent Number: 5,931,465

[45] Date of Patent: Aug. 3, 1999

[54] GAME DEVICE

[75] Inventors: Junji Miyake; Shinji Watanabe; Tomohiro Matsunaga; Hiroyasu Suzuki; Masahito Yanase; Shigetoshi Mizuno, all of Tokyo, Japan

[73] Assignee: Sega Enterprises, Ltd., Tokyo, Japan

[21] Appl. No.: 08/945,686

[22] PCT Filed: Mar. 4, 1997

[86] PCT No.: PCT/JP97/00660

§ 371 Date: Mar. 5, 1998

§ 102(e) Date: Mar. 5, 1998

[87] PCT Pub. No.: WO97/32640

PCT Pub. Date: Sep. 12, 1997

[30] Foreign Application Priority Data

Mar. 6, 1996 [JP] Japan ..... 8-075416
Nov. 15, 1996 [JP] Japan ..... 8-305348

[51] Int. Cl.[6] ..... A63F 7/06

[52] U.S. Cl. ..... 273/108.1; 273/126 A; 273/121 D; 273/122 A

[58] Field of Search ..... 273/108, 108.1, 273/126 R, 126 A, 121 A, 121 D, 122 A, 108.56

[56] References Cited

U.S. PATENT DOCUMENTS 3,887,187 6/1975 Crossman et al. ..... 273/126 A
3,927,885 12/1975 Crossman et al. .
4,032,150 6/1977 Wilson .
4,076,242 2/1978 Joseph ..... 273/108.56 X
4,109,916 8/1978 Breslow et al. ..... 273/121 D X
4,173,338 11/1979 Barnett .
4,173,341 11/1979 Olliges ..... 273/126 A
4,480,833 11/1984 Barcelow et al. ..... 273/126 A X
5,110,128 5/1992 Robbins ..... 273/126 A
5,358,243 10/1994 Eddy et al. ..... 273/121 D
5,364,096 11/1994 Cebula et al. .
5,368,300 11/1994 Becker ..... 273/119 R X
5,556,093 9/1996 Lankiewicz et al. ..... 273/126 A

FOREIGN PATENT DOCUMENTS 63-82682 4/1988 Japan .
8-299584 11/1996 Japan .

*Primary Examiner*—Raleigh W. Chiu
*Attorney, Agent, or Firm*—Dickstein Shapiro Morin & Oshinsky LLP

[57] ABSTRACT

The present invention is embodied in a game device for playing a game in which a moving body is levitated above a play field board by air emitted from a number of holes formed in the play field board. A moving body feeding device automatically feeds the moving body onto the play field board. After use, the moving body is recovered, lifted above the play field board, and dropped into guides which guide the moving body onto the play field board.

13 Claims, 11 Drawing Sheets

GAME DEVICE

TECHNICAL FIELD

The present invention relates to a game device for playing a game by moving on a play field board a moving body levitated by air emitted.

BACKGROUND ART

Hitherto, a game device for simulating an actual ball game such as hockey or soccer in which the game is played by moving a moving body levitated by air emitted in a state of small friction resistance has been known.

In such an air hockey game device, many holes are formed in a rectangular play field board spread over an upper surface of a game device box body and a disk-shaped puck is levitated by air emitted from the holes. Goals are provided on the right and left of the play field. Players standing behind the goals facing to each other repel the puck with mallets to compete for putting the puck in the goal of the opponent.

As the puck levitated has very small friction resistance and moves smoothly, a taste like the ice hockey can be obtained.

In such a manner, two players hit a puck mutually and victory or defeat is decided by the number of goals within a predetermined time.

When the puck enters one of the goals, the puck falls in a puck receptor opening on a side face of the game device box body and the player takes out the puck from the puck receptor to return it on the play field for starting the game again.

Therefore, the player has to take out the puck and place it on the play field every time the puck enters the goal. It is troublesome so that the player sometimes can not concentrate on the game and loss the interest.

If feeding puck is left to the player, the puck apt to be fed in an unnatural posture, because the player intends to place the puck on the ply field in a hurry. If the puck of the unnatural posture is hit by the mallet, an orbiting path of the puck becomes upward to cause an inconvenience that the puck jumps out of the field.

DISCLOSURE OF INVENTION

The present invention has been accomplished in view of the foregoing and an object of the present invention is to provide a game device in which work of the player to feed the moving body on the play field is excluded, an inconvenience related to feed of moving body is dissolved and the player can concentrate on the play to be excited.

In order to achieve the object, the present invention provides a game device for playing a game by moving on a play field board a moving body levitated by air emitted from a number of holes formed in the play field board, comprising a moving body feeding device for automatically feeding the moving body onto the play field board.

Since the moving body is fed to a position suitable for hitting it on the play field board automatically by the moving body feeding device, the player is not required to place the moving body on the play field board himself, and can concentrate on the play only to be excited.

The moving body can be fed onto the play field board always in a pertinent posture and to a pertinent position, therefore an inconvenience such that the moving body jumps out of the field by operation of the player can be avoided.

The above-mentioned moving body feeding device comprises recovery means for recovering the moving body after use, lifting means for lifting the moving body recovered by the recovery means above the play field board, dropping means for dropping the moving body lifted by the lifting means, and guide means for guiding the moving body dropped by the dropping means onto the play field board.

The moving body recovered by the recovery means is next lifted above the play field board by the lifting means, dropped by the dropping means and then guided and fed onto the play field board by the guide means, thus the moving body can be fed automatically onto the play field board always pertinently.

The guide means may have a discharge outlet positioned at a height near an upper surface of the play field board, thereby the dropped moving body is guided so as to run out horizontally onto the play field board when moving direction of the moving body is changed to about horizontal direction. According to this constitution, the moving body is ejected onto the play field board as if it glides horizontally so that the moving body is fed onto the play field board always in a pertinent posture and an inconvenience such that the moving body jumps out of the field by operation of the player can be avoided surely.

The game device may be so constituted that the play field board is shaped in a rectangle; goals are provided at right and left symmetrical positions of the play field board; the recovery means recovers the moving body after use entering the goal to a lower portion at a middle of a front or rear side edge of the play field board; and the lifting means, the dropping means and the guide means are arranged above the lower portion where the moving body is recovered by the recovery means.

According to this constitution, in a game for competing with an opponent for putting the moving body in the goal of the opponent at right or left side of the plat field, the moving body put in one of the right and left goals is recovered to the lower portion at the middle of the front or rear side edge of the play field board, and ejected onto the play field board from the guide means disposed at the middle of the side edge of the play field board above the position where the moving body is recovered. Therefore, the moving body can be fed automatically always to a position suitable for the player to hit the moving body easily.

According to the game device wherein the lifting means lifts a plurality of the moving bodies recovered by the recovery means continuously, and the dropping means drops the moving bodies lifted by the lifting means one by one, it is possible to store a plurality of the moving bodies for feeding the moving body one by one quickly when it is needed.

According to the game device having an opening width adjustment means for adjusting width of an opening in the goal which the moving body enters, difficulties for putting the moving body in the goal can be changed and a game which is most pertinent in accordance with skill of the player and the number of players can be set.

According to the game device having a operation switch for instructing drive of the opening width adjustment means, the player can adjust the opening width arbitrarily by operating the operation switch.

According to the game device wherein the play field board is shaped in a rectangle; goal openings are provided at right and left symmetrical positions of the play field board; and the moving body feeding device includes used moving body recovery means having a first conveyor provided under the goal opening, a gate provided at a take-out place of the first conveyor for letting the moving bodies pass one by one, and detection means for detecting the moving body passing through the gate, the moving body entering the goal opening is transported by the first conveyor forcibly, passes through the gate and is detected by the detection means rapidly. Therefore, a score, for example, can be indicated quickly without losing interest of the player. Further, even in case that a plurality of moving bodies enter the goal opening at the same time, it is avoided that a plurality of moving bodies pass through the gate at the same time because the gate allows only one moving body to pass. The detection means can detect the moving body one by one in turn surely.

According to the game device wherein a second conveyor under the gate for receiving and transporting the moving body detected by the detection means, and a recovery passage having an upper stream end positioned under a carry-out place of the second conveyor and inclined for moving the moving body to a predetermined position are provided, and the second conveyor transports the moving body at a speed higher than that of the first conveyor, since a speed at which the second conveyor transports the moving body is higher than a speed at which the first conveyor transfers the moving body to the second conveyor so that the second conveyor transports the moving bodies with intervals more than a predetermined length to the recovery passage, it is avoided that the moving bodies clog an entrance of the recovery passage.

In the above-mentioned game device, if the gate is a plate member standing at the take-out place of the first conveyor and having an opening at the same height as the first conveyor for allowing one piece of the moving body to pass, even in case that a plurality of moving bodies are transported placed in heaps on the first conveyor, moving bodies positioned at an upper portion of the heap are prevented from passing the opening of the gate by the surrounding edge of the opening, and only the lowermost moving body can pass through the opening.

The moving body prevented from passing becomes the lowermost one eventually and passes through the gate.

Thus, even if a plurality of moving bodies are transported by the first conveyor at the same time, the gate controls automatically the moving bodies so as to pass through the gate opening one by one in turn, therefore the detection means can detect the moving bodies one by one surely.

If a frame rail is projected along circumference of the play field board and the goal openings are formed at right and left symmetrical positions of the frame rail, the game device can be applied to a game in which the moving body strikes the frame rail and bounds back as a hockey game for example.

If the moving body is shaped in a disk, the moving body can be compared to the puck of the hockey game and a exciting game resembling the actual game can be realized.

If the first and second conveyors are belt conveyors, the construction can be simplified to lower the cost.

THE BEST MODE FOR CARRYING OUT THE INVENTION

Figure 1:
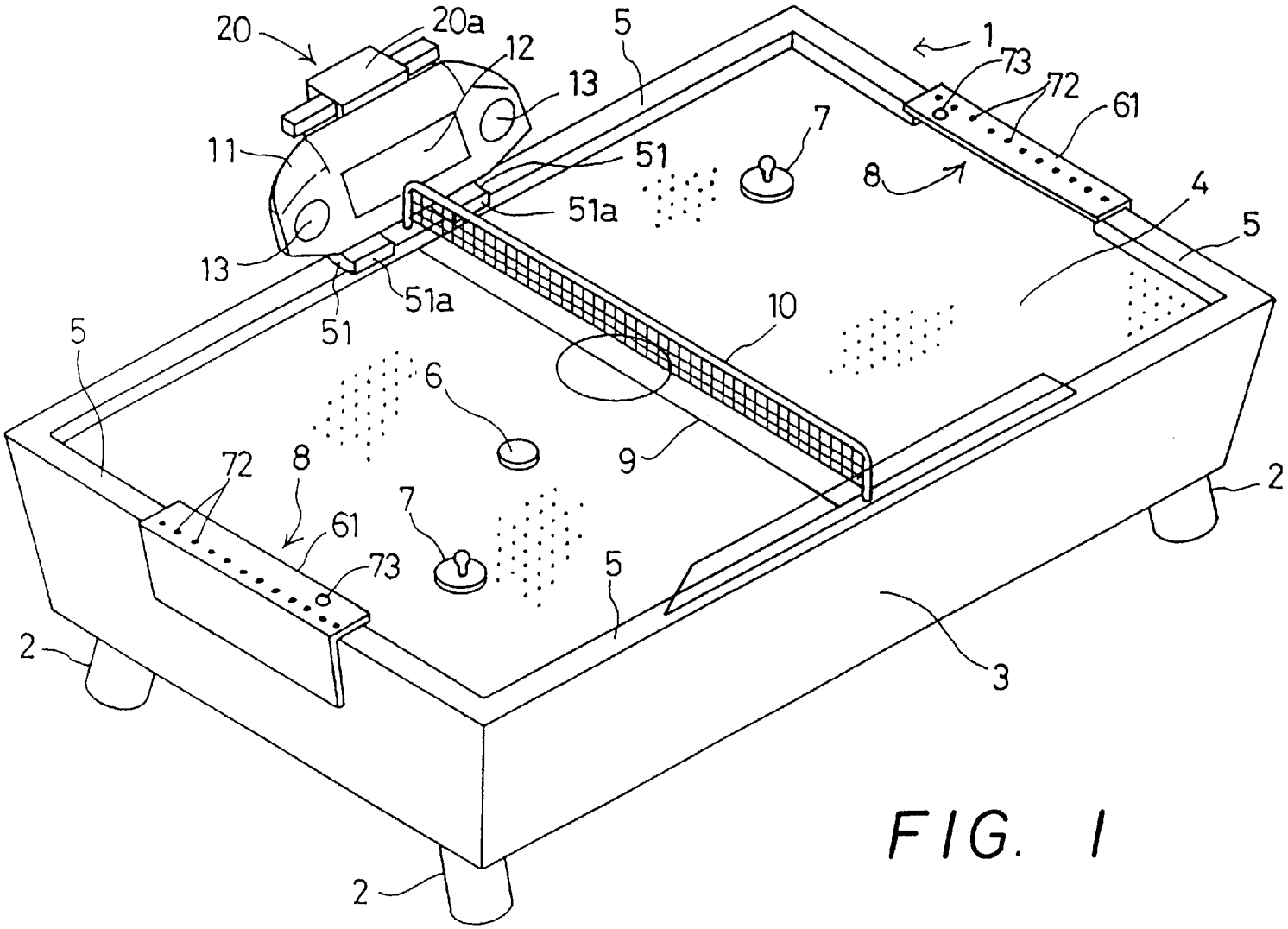
FIG. 1 is a whole outside view of an air hockey game device according to an embodiment of the present invention.

Hereinafter, an embodiment of the present invention will be described with reference to FIGS. 1 to 9. The embodiment is an air hockey game device 1 for simulating the actual hockey of which whole outside view is shown in FIG. 1.

A rectangular play field board 4 is spread over an upper surface of a rectangular parallelepiped box body 3 supported by four leg portions 2. The circumference of the play field board 4 is fringed high by a frame rail 5. The play field board 4 is made of a plane and durable member such as melamine resin and has many holes formed all over the surface.

Within the box body 3 are formed an air chamber communicating with the holes of the play field board 4. Air is supplied into the air chamber by a fan not shown and emitted upward through the holes.

A disk-shaped puck 6 fed onto the play field board 4 is levitated by the air emitted from the holes, therefore friction resistance acting on the puck 6 is very small and the puck 6 moves smoothly.

At each middle position of both right and left sides of the rectangular frame rail 5 is provided a goal 8 having a opening directed to the field. Above the center line 9 partitioning the play field into right and left camps is provided a net 10 bridging front and rear sides of the frame rail 5. And at a middle position of the rear side of the frame rail 5 are projected a main body section 20*a* of an automatic puck feeding device 20 by which the puck 6 is automatically fed onto the play field board 4.

Players part in right and left camps and stand behind respective goals 8 for manipulating respective mallets 7 to play. The mallet 7 is formed with a grip projected upward at a center of a disk section. The player holds the grip to slide the mallet 7 on the play field board 4 and hit the puck 6 with the mallet 7 for shoot.

Figure 2:
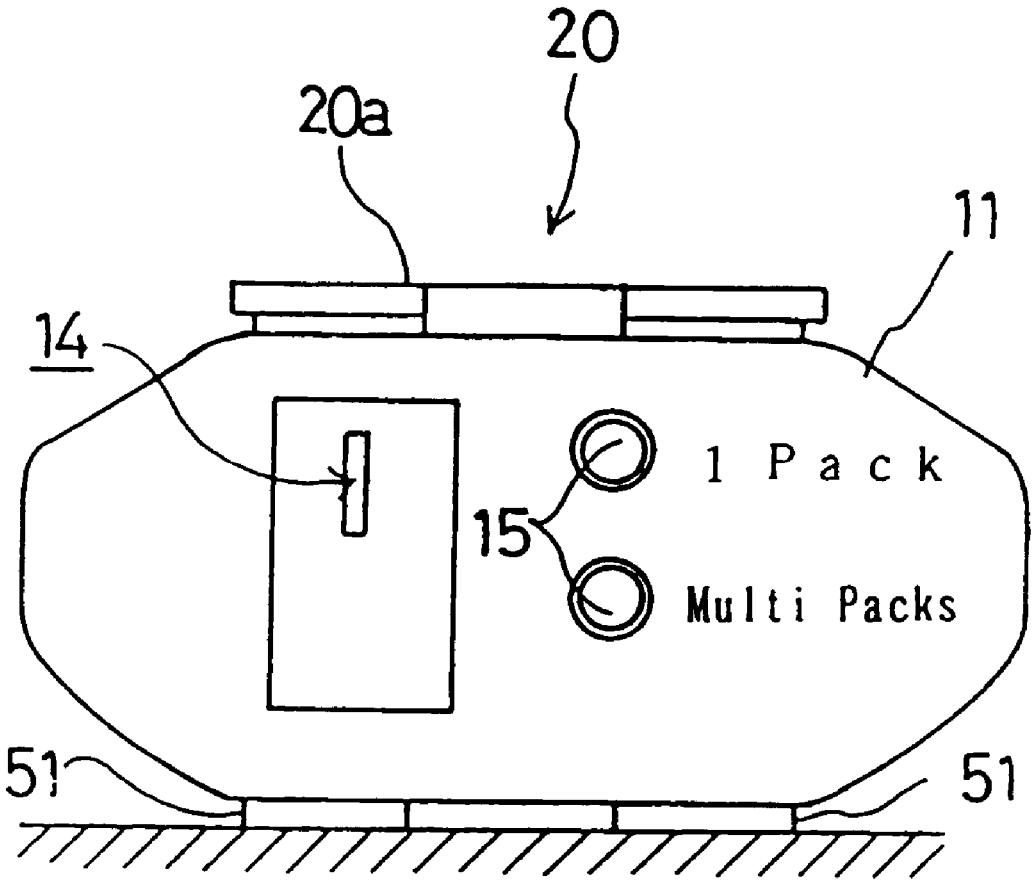
FIG. 2 is a back side view of a main body section of an automatic puck feeding device.

The main body section 20*a* of the automatic puck feeding device 20 is covered by a case 11 which is long sideways and inclined somewhat. On a obverse surface of the case 11, an indication section 12 for indicating scores and the like is disposed at the center and speakers 13 are arranged on the right and left side thereof. As shown in FIG. 2, on a reverse surface of the case 11, a coin slot 14 and selection buttons 15 for selecting kinds of game are disposed.

Figure 3:
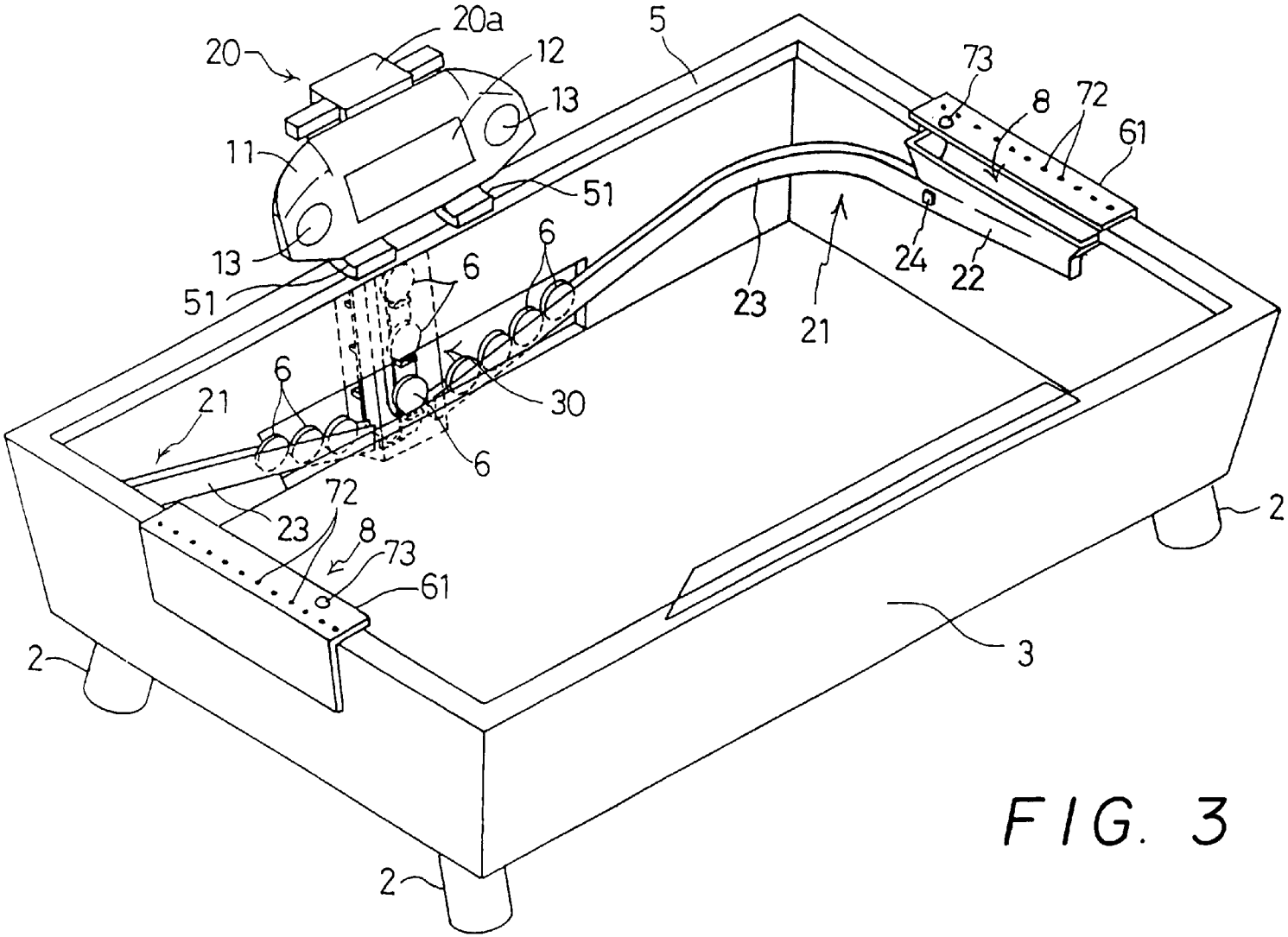
FIG. 3 is a perspective view showing interior of a box body of the air hockey game device from which a play field board and an air emitting mechanism are omitted.

In FIG. 3 showing the interior of the box body 3 from which the play field board 4 and an air emitting mechanism are omitted, a puck recovery mechanism 21 for recovering the puck 6 entering the goal 8 and a part of a puck lifting mechanism 30 are shown.

The puck recovery mechanism 21 comprises receptacles 22, 22 provided under the right and left goals 8, 8 for receiving the puck 6 entering the goal 8, and flat recovery passages 23, 23 having U-shaped sections extending from the receptacles 22, 22 along the inner surface of the box body 3. The recovery passages 23, 23 further extend along the rear side wall of the box body 3 to a position under the main body section 20*a* of the automatic puck feeding device 20 maintaining a predetermined inclination.

A lower half portion of the puck lifting mechanism 30 extends below the play field board 4 from the main body section 20*a* of the automatic puck feeding device 20 and the recovery passages 23, 23 approach to the bottom portion of the puck lifting mechanism 30 from the both sides.

Therefore, the puck 6 entering the opening of the goal 8 is dropped in the receptacle 22, then led to the recovery passage 23, and rolls on the inclined path of the recovery passage 23 by its own weight to reach the bottom portion of the puck lifting mechanism 30.

The receptacle 22 is provided with a score sensor 24 at a joint part to the recovery passage 23 to detect the puck 6 reaching the goal and outputs a detection signal.

Figure 5:
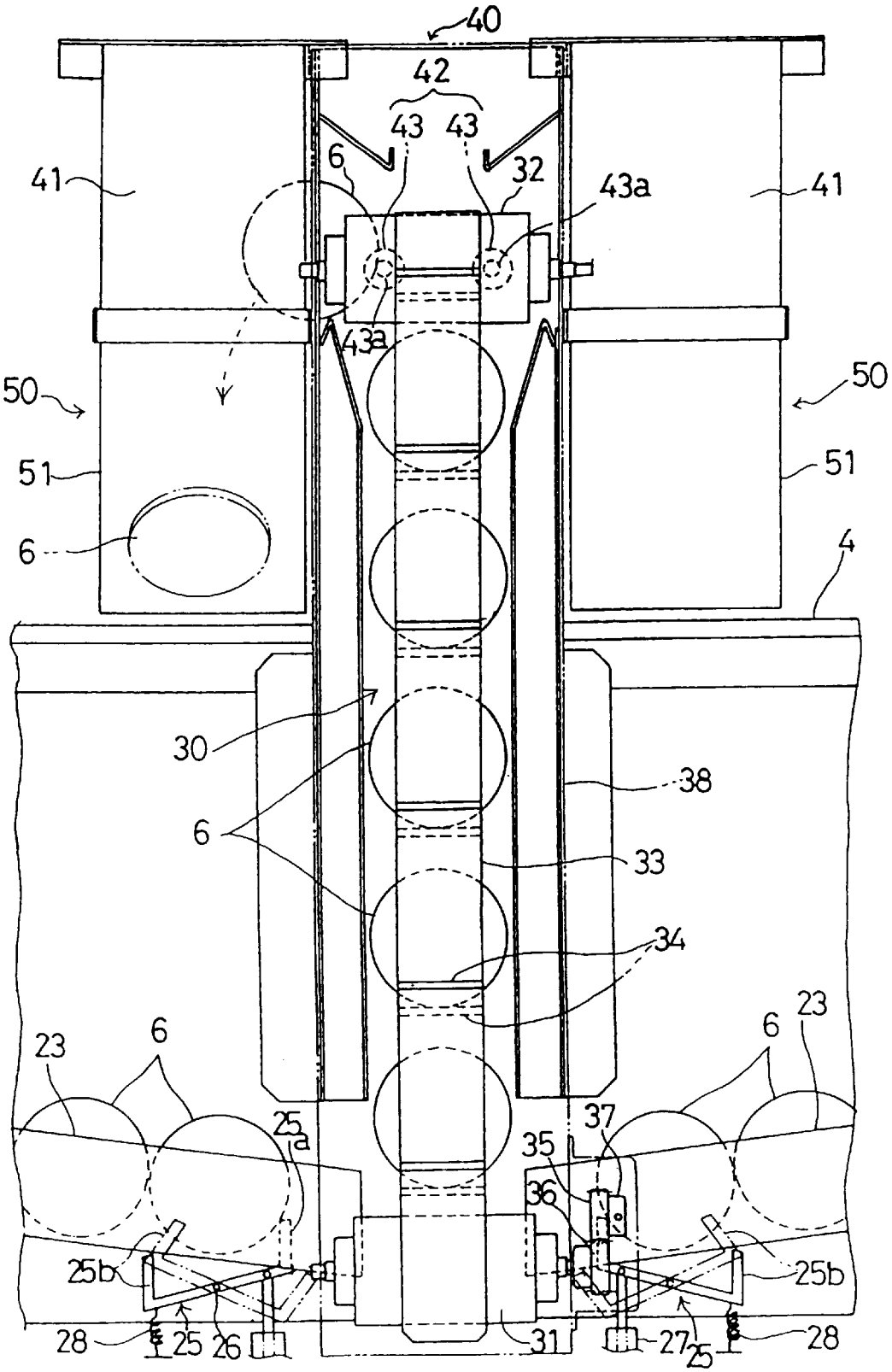
FIG. 5 is a back side view thereof.
Figure 6:
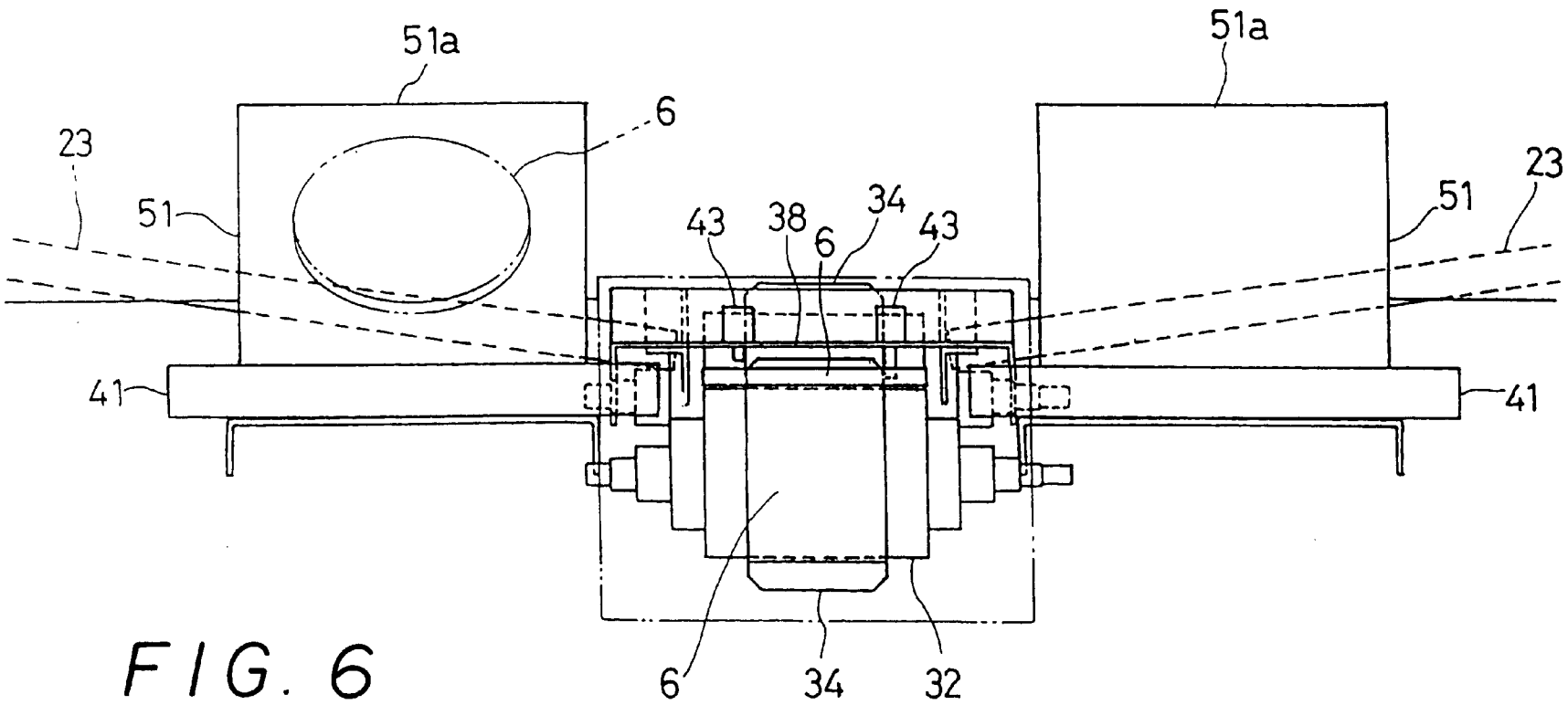
FIG. 6 is a top view thereof.

As shown in FIG. 5, in the vicinity of an outlet of the recovery passage 23, engaging fingers 25*a*, 25*b* of a stopper 25 are projected from the bottom plate of the recovery passage 23 to engage with and stop the puck 6 rolling down.

The stopper 25 having a center pivotally supported by a pivot 26 is laid under the recovery passage 23 about in parallel therewith and the engaging fingers 25*a*, 25*b* are projected at both ends of the stopper 25 respectively. The distance between the engaging fingers 25*a*, 25*b* is about equal to the outer diameter of the puck 6. A rod 27*a* of a solenoid 27 is pivoted to one end of the stopper 25 and a spring 28 is connected to another end of the stopper 25.

Therefore, the stopper 25 is driven by the solenoid 25 to swing about the pivot 26. In the case that the engaging finger 25*a* of lower stream side is projected in the recovery passage 23 as shown in FIG. 5, the puck 6 at the front is stopped by the engaging finger 25*a* and following pucks 6 line up at the upper stream side of the front puck.

When the solenoid 27 is excited, the stopper 25 is swung against the spring 28 so that the engaging finger 25*a* of lower stream side is retracted as shown by the dot-dash line in FIG. 5 and the puck 6 which was stopped by the engaging finger 25*a* rolls out to be fed to the bottom portion of the puck lifting mechanism 30. At the same time that the engaging finger 25*a* is retracted, the engaging finger 25*b* of upper stream side is projected in the recovery passage 23 and engaged with the following puck 6 to stop it.

After that, the excitation of the solenoid 27 is canceled and the stopper 25 is swung back by the spring 28 to the former state (the state shown by the solid line in FIG. 5). The puck 6 which was stopped by the engaging finger 25*b* of upper stream side rolls down and is stopped by the engaging finger 25*a* of lower stream side, and the whole becomes again the state as shown by the solid line in FIG. 5. Thus, every time the solenoid is driven, a puck 6 is fed to the bottom portion of the puck lifting mechanism 30.

Next, the puck lifting mechanism 30 will be described. The puck lifting mechanism 30 has a pulley 31 positioned below the play field board 4, a pulley 32 positioned above the play field board 4 and an endless belt 33 wound round the pulleys 31, 32 in a somewhat inclined posture. The lower pulley 31 is driven through gears 35, 36 by a motor 37 to run the belt 33, thereby the part of the belt 33 coming in front moves upward.

On the outer circumferential surface of the belt 33, a plurality of support bars 34 each directed breadthwise of the belt are arranged at regular intervals in the circumferential direction and projected.

The belt 33 is accommodated in an angular barrel-shaped case 38 long in the vertical direction. The barrel-shaped case 38 is constructed so as to penetrate the case 11, which is long sideways and provided with the indication section 12 etc., and projects upward.

The puck 6 recovered by the aforementioned puck recovery mechanism 21 is fed to a lower end on front side of the belt 33 at the bottom portion of the puck lifting mechanism 30 one by one by the stopper 25, and supported on the support bar 34 coming round the lower pulley 31.

The outer diameter of the puck 6 is larger than the width of the belt 33, but the belt 33 itself is somewhat inclined so that the front side part of the belt 33 (called the front side belt 33 in the following) faces barely upward. Therefore, the puck 34 supported by the support bar 34 is placed on the front side belt 33 stably and brought upward with running of the belt 33.

The puck 6 is guided by the barrel-shaped case 38 and lifted from the position below the play field board 4 to a high position above the play field board 4.

At an upper portion of the puck lifting mechanism 30 is provided a dropping mechanism 40. The dropping mechanism 40 comprises detour passages 41, 41 extending right and left and the puck 6 lifted to the upper pulley 32 is led to any one of the right and left detour passages by distributing means 42 and dropped.

The distributing means is constituted by solenoids 43, 43 which are disposed in front of and on right and left both sides of the front side belt 33 at about the same height as the upper pulley 32. Rods 43*a*, 43*a* of the solenoids 43, 43 are projected toward the rear side belt 33 and reach vicinities of side edges of the belt 33 when projected.

Right and left side portions of the puck supported by the support bar 34 protrude from the belt 33 because the diameter of the puck 6 is larger than the width of the belt 33, therefore, if the rod 43*a* of one of the solenoids 43 is projected, a side portion of the puck 6 lifted to the detour passage 41 comes into contact with the projected rod 43*a* and the puck 6 moves horizontally to go off the support bar 34 and enter the detour passage 41.

Namely, referring to FIG. 5, if the rod 43*a* of the right side solenoid 43 is projected, the puck 6 coming into contact with the rod 43*a* goes to the left detour passage 41. To the contrary, if the rod 43*a* of the left side solenoid 43 is projected, the puck 6 goes to the right detour passage 41.

Thus, the puck 6 lifted by the puck lifting mechanism 30 is distributed in any one of right and left by the solenoids 43.

Guide mechanisms 50 are provided under the right and left detour passages 41 respectively. The guide mechanisms 50 are connected with the lower portions of the detour passages 41 and have guide passages 51 hanged at lower portions of the guide mechanisms 50.

Figure 4:
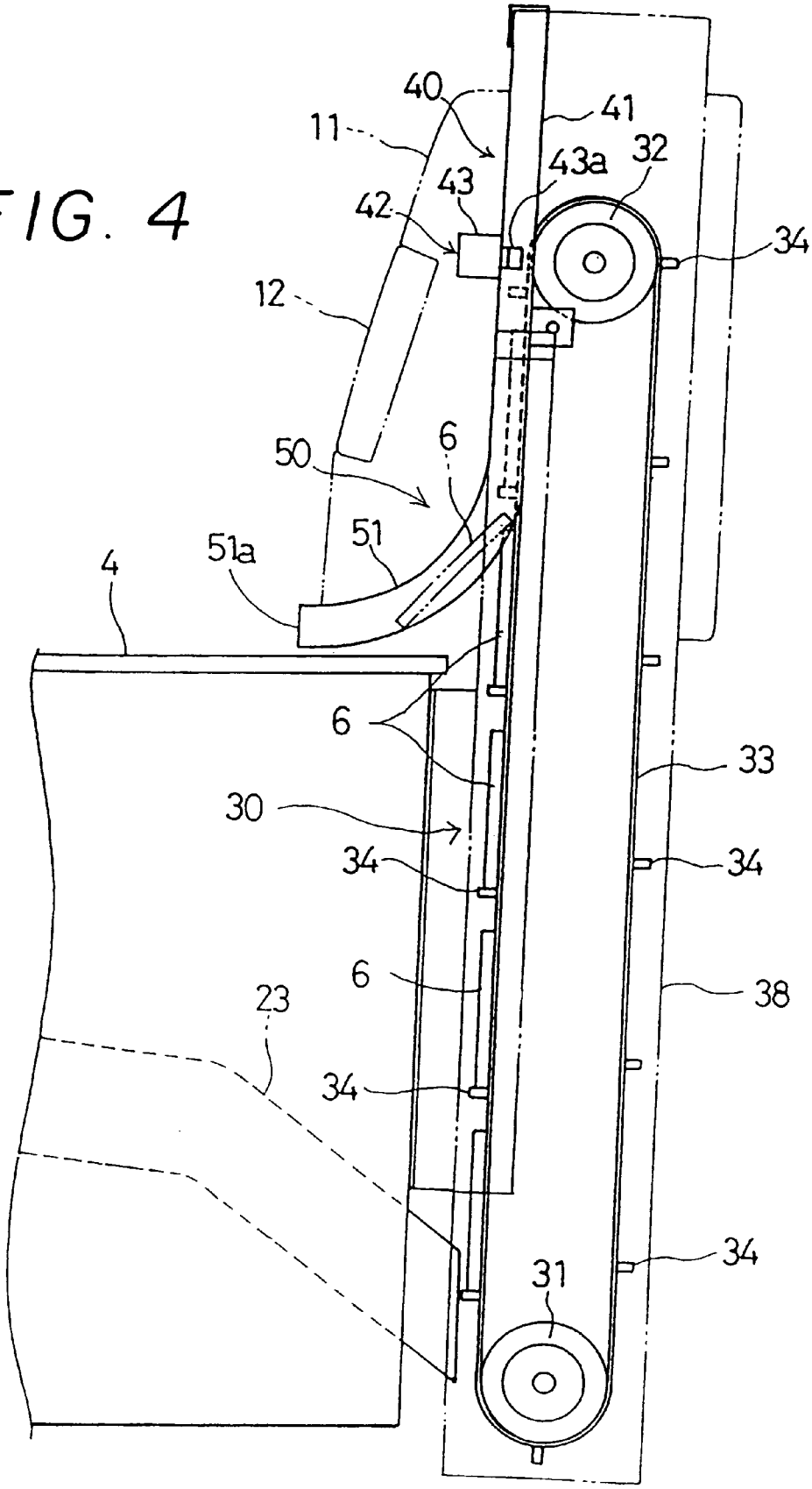
FIG. 4 is a sectional side view of an essential part of the automatic puck feeding device.

The guide passage 51 has a flat and closed square section and gradually changes its direction with advancing downward and at a position where the guide passage 51 becomes about horizontal is formed an end opening 51*a* (see FIG. 4).

The opening 51*a* is disposed at a position somewhat higher than the upper surface of the play field board 4.

The puck 6 entering the guide passage 51 through the detour passage 41 falls guided by the passage 51, changes the direction at the bent portion of the passage 51 and is ejected horizontally from the opening 51*a* when the direction becomes about horizontal.

On the one hand, the goal 8 has a flat rectangular opening formed under a cover plate 61. The width of the opening is adjustable by an opening width adjustment mechanism 60 which will be described with reference to FIGS. 7 to 9.

A horizontal plate 62 forming the same surface as the surface of the play field board 4 extends from the opening of the goal 8 to the interior. At front and rear both ends of the horizontal plate 62 are formed rectangular openings 62*a* in which gate members 63 are provided so as to appear and disappear.

The gate member 63 is formed about in a rectangular parallelepiped and has projecting bifurcate lower ends forming a pair of bearing sections 63*a* to which a pin 64 is fitted horizontally. On the pin 64 is pivoted an end of a swing bar 65 having an about middle portion pivotally supported by a fixed supporting shaft 66. Another end of the swing bar 65 is connected through a spring 67 to a rod 68*a* of a solenoid 68 positioned below.

A spring 70 is provided between the pin 64 and a pin 69 projected under the pin 64 to force the gate member 73 downward and the swing bar 65 in one direction. The swing bar 65 forced by the spring is abutted against a stopper 71 to be maintained in an about horizontal posture.

Figure 7:
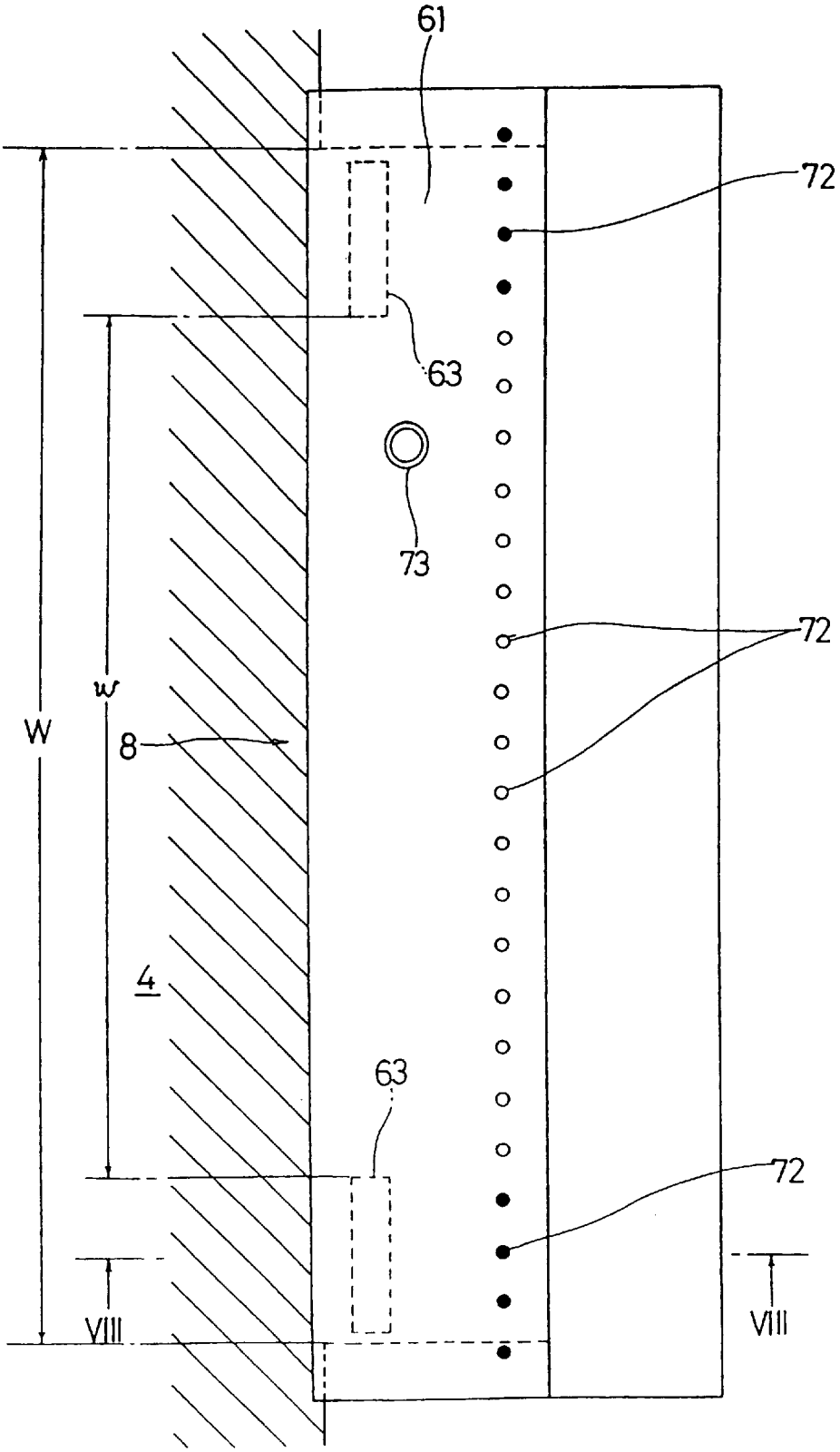
FIG. 7 is a plan view showing a neighborhood of a goal.
Figure 8:
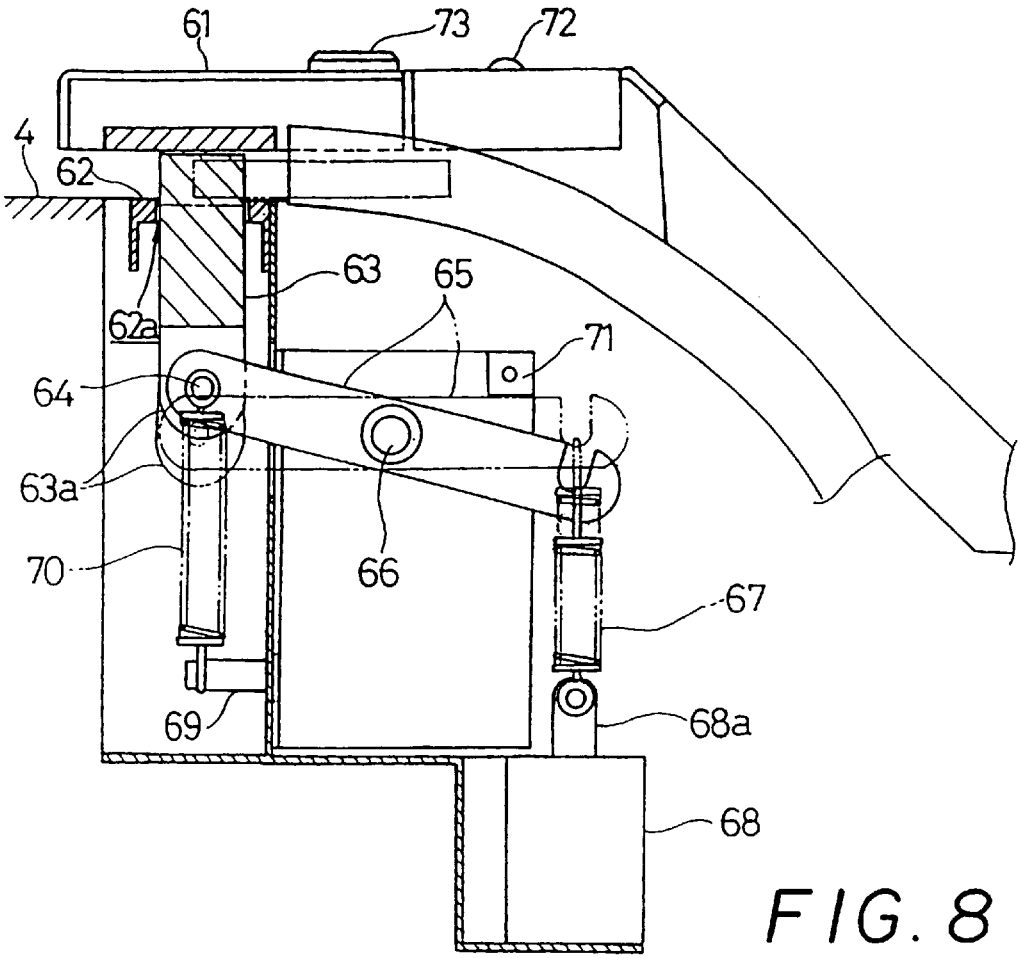
FIG. 8 is a section taken along the line VIII—VIII of FIG. 7.
Figure 9:
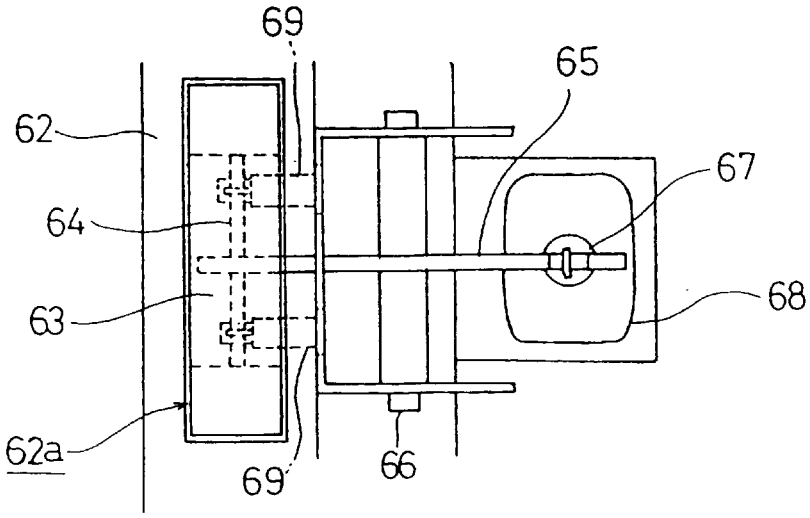
FIG. 9 is a top view of an essential part of the goal.

When the solenoid 68 is not excited, the swing bar 65 is kept in the about horizontal posture by the tension of the spring 65 as shown by the dot-dash line in FIG. 8, the gate member 63 is in a lowered state that the member 63 is sunk in the rectangular opening 62*a* of the horizontal plate 62, and the opening width of the goal 8 is set at the original maximum opening width W (FIG. 7).

When the solenoid is excited, the rod 68*a* retracts to tilt the swing bar 65 through the spring 67 as shown by the solid line in FIG. 8, the gate members 63 project upward from the rectangular openings 62*a* of the horizontal plate 62 to close both ends of the opening of the goal 8 and thus the opening width is narrowed to a narrow opening width w (FIG. 7).

Even if the puck or the like is pinched by the gate member 63 when it projects, the solenoid is not imposed an unnecessary burden because the spring 67 is lengthened.

On the upper surface of the cover plate 61 of the goal 8, a plurality of LED 72 is arranged in a line spreading all over the maximum opening width W and a manipulation button 73 is disposed.

Every time the player pushes the manipulation button 73, the front and rear solenoids 68 are excited or demagnetized at the same time and some LED 72 in the vicinities of both ends among a plurality of the LED 72 are turned on or turned off to show opening width of the goal 8.

That is, when the solenoid 68 is demagnetized, all of the LED 72 are turned on to show that the opening is set at the maximum opening width W, and when the solenoid 68 is excited, as shown in FIG. 7, LED 72 at the both end portions are turned off and the other LED 72 at the remaining central portion corresponding to the narrowed opening width w are turned on to show the narrow opening width.

Therefore, the player can set the opening width of the goal 8 at any one of larger and smaller widths W, w arbitrarily by manipulating the manipulation button 73.

For example, when three players play a game by two-vs.-one, the goal 8 of the disadvantageous camp having only one player may be narrowed leaving another goal 8 at the maximum opening width, so that an equally matched competition can be carried out and the three players can enjoy the play at the same time.

Even in a one-vs.-one competition between two players having skills different from each other, for example an adult and a child, if the opening width of the goal 8 of a player inferior in the skill is narrowed and another goal 8 is set at the maximum opening width, the game can be played amusingly.

Though the opening width of the goal 8 is set at one of two states, wide and narrow, in the above-mentioned embodiment, the goal 8 may be made so that the opening width can be widened and narrowed gradually and adjusted to an arbitrary width.

In the aforementioned automatic puck feeding device 20 of the air hockey game device 1, drives of the motor 37 of the lifting mechanism 30 and the solenoids 43 of the distribution means 42 are controlled by a microcomputer which receives inputs such as detection signal of the coin thrown into the coin slot 14, selection signal of the selection button 15 and detection signal of the pack 6 entering the goal by the score sensor 24, and controls indication on the indication section 12 and sounds of the speaker 13 as well as the drives of the motor 37, solenoids 43 and the like.

Initially, in the automatic puck feeding device 20 are provided many pucks 6. Namely, the support bars 34 on the front side belt 33 of the puck lifting mechanism 30 support the pucks 6 respectively, and the right and left recovery passages 33 of the puck recovery mechanism 21 stock a plurality of pucks 6 in rows stopped by the stoppers 25.

The game starts when the player throws a coin into the coin slot 14 on the reverse surface of the main body section 20*a* and manipulates the selection button 15 to select kind of the game.

In case of the present automatic feeding device 20, a one-puck game in which always one puck 6 is treated at a time, and a multi-pucks game in which sometimes three pucks 6 are treated in a time, can be selected by the selection button 15.

The manipulation button disposed at the goal 8 can be manipulated whenever to adjust the opening width of the goal 8 suitably.

When the game starts, air begins to be emitted from many holes of the play field board 4 and the rod 43*a* of any one of the solenoids 43 selected at random is projected. Then, the motor 37 of the puck lifting mechanism 30 is driven during a predetermined time to run the belt 33. The pucks 6 supported on the belt 33 are lifted and a side portion of the uppermost puck 6 comes into contact with the projected rod 43*a*, therefore, the uppermost puck 6 moves to the corresponding detour passage 41 and drops passing through the guide passage 51 connected with the detour passage 41.

Therefore, from right or left guide passage 51 decided at random is ejected the puck 6 onto the play field board 4.

Since the opening 51*a* is directed forward from a central position of the rear side of the play field board 4 nearby and in parallel with the play field board 4, the puck 6 coming down by its own weight changes direction into horizontal guided by the guide passage 51 to be ejected from the opening 51*a*. The puck 6 is supported on the air emitted upward and moves smoothly as if it glides along the play field board 4 to a proper position on the play field board 4 near one of the camps.

Since the puck 6 is fed onto the play field board 4 in a proper horizontal posture always, even if the player hits the puck 6 with the mallet 7 directly after the puck 6 is ejected, the mallet strikes against the outer circumferential surface of the puck 6. Therefore, an inconvenience that the puck 6 jumps out of the field because the mallet 7 strikes against a flat face of the puck 6 in an abnormal posture does not occur.

When one puck 6 is fed onto the play field board 4, the stopper 25 of one of the recovery passages 23 operates to move the foremost puck 6 having been stopped by the stopper 25 onto the lowermost empty support bar 34 on the front side belt 33 of the puck lifting mechanism 30. Thus, a plurality of pucks 6 are always standing by to be fed onto the play field board 4 soon as occasion demands.

In case of the multi-pucks game, too, at first one puck 6 is fed onto the play field board 4, and the player hits the puck 6 with the mallet 7 to shoot aiming at the goal 8 of the opponent.

Besides the case that two players compete with each other by one-vs.-one, a competition of two-vs.-two and other irregular games are also possible.

When the puck 6 enters one of the goals 8, the puck 6 is received in the receptacle 22, rolls on the inclined recovery passage 23 and takes the rearmost position of the pucks 6 lined up already.

The puck 6 reaching the goal 8 is detected by the score sensor 24 and the detection signal is inputted into the microcomputer which indicates a new score on the indication section 12, drives the speaker to generate a sound, drives one of the solenoids 43 of the distribution means to project the rod 43*a* for feeding a new puck 6 to the defeated side camp, and then drives the motor 37 to eject a puck 6 from one of the guide passages 51 to the defeated side camp. Thus, a game can be carried out by a rule corresponding to the service right in the actual game.

In case of multi-pucks game time-zone, after the first puck is fed to the defeated side camp, a second puck 6 is fed to the winning side camp and then a third puck 6 is fed to the defeated side camp, so that three pucks 6 in all are fed onto the play field board in succession. Therefore, the players attack and defend with the three pucks 6 in sight to enjoy a more exciting game.

If all of the three pucks 6 reach the goal within a time period predetermined for the game, next three pucks 6 are fed again in succession, the first puck being fed to a camp which was defeated more. The multi-pucks game time-zone can be changed arbitrarily by a soft program.

As described above, in the air hockey game device 1, the puck 6 is fed onto the play field board 4 by the automatic puck feeding device 20, so that the player is not required to take out the puck 6 from interior of the goal 8 and place it on the play field board 4, and can concentrate on the play only to be excited.

Since the puck 6 is fed by the automatic puck feeding device 20 in stead of a man, it is possible to feed the puck 6 onto the play field board 4 always in a pertinent posture and to a pertinent position.

Since many pucks 6 are stocked in the box body 3, even if a puck 6 is lost, the device is available without interruption only by switching on again.

In the aforementioned multi-pucks game, three pucks were treated at the same time, but the number of pucks to be treated at the same time is not limited to three.

The end opening 51*a* of the guide passage 51 is formed at a position somewhat higher compared with the play field board 4 with a step difference, so that the puck 6 ejected horizontally can get on the air emitted from the play field board 4 smoothly and the step difference prevents the puck 6 approaching the opening 51*a* levitated by the air on the play field board 4 from entering the opening 51*a* in the opposite direction.

Figure 10:
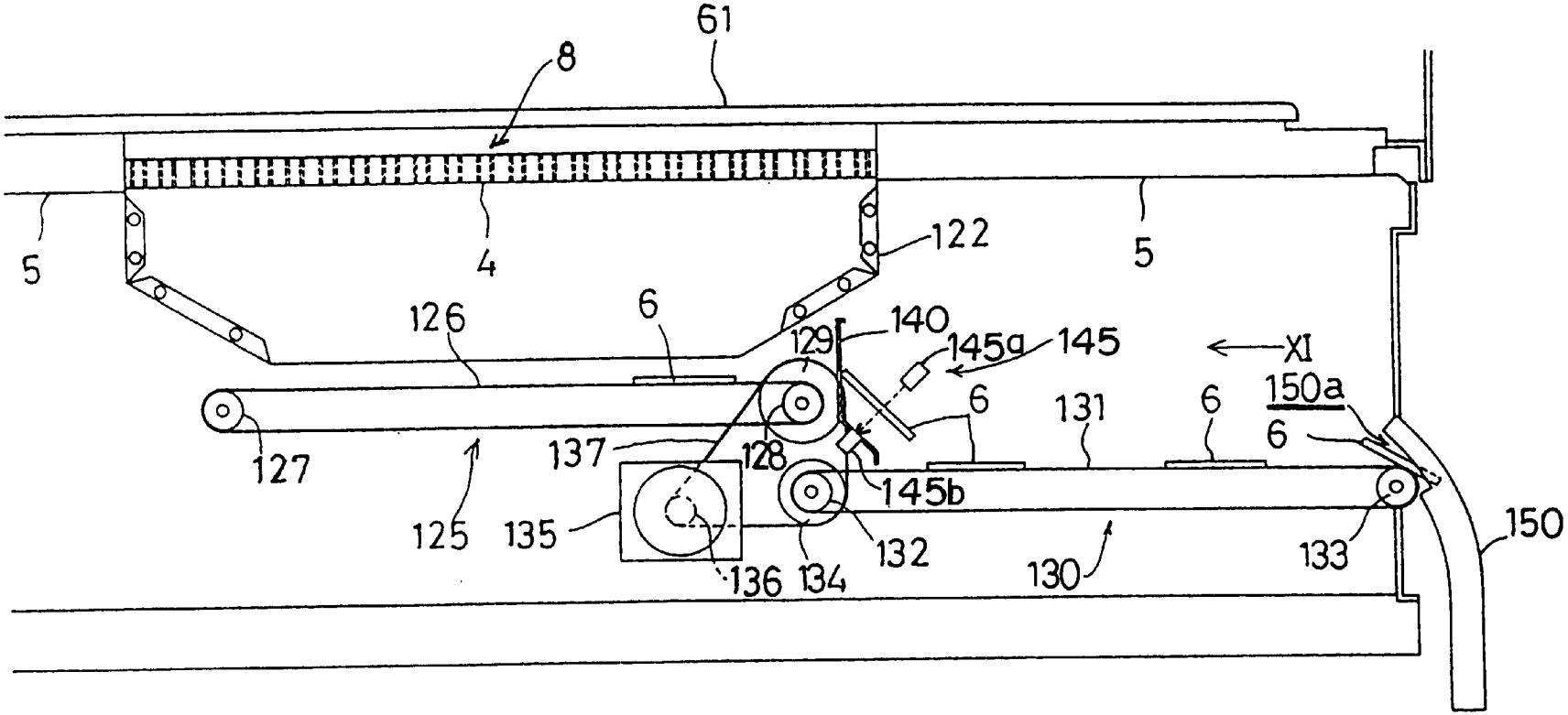
FIG. 10 is a partly omitted side view showing another embodiment of the puck recovery mechanism under the goal.
Figure 11:
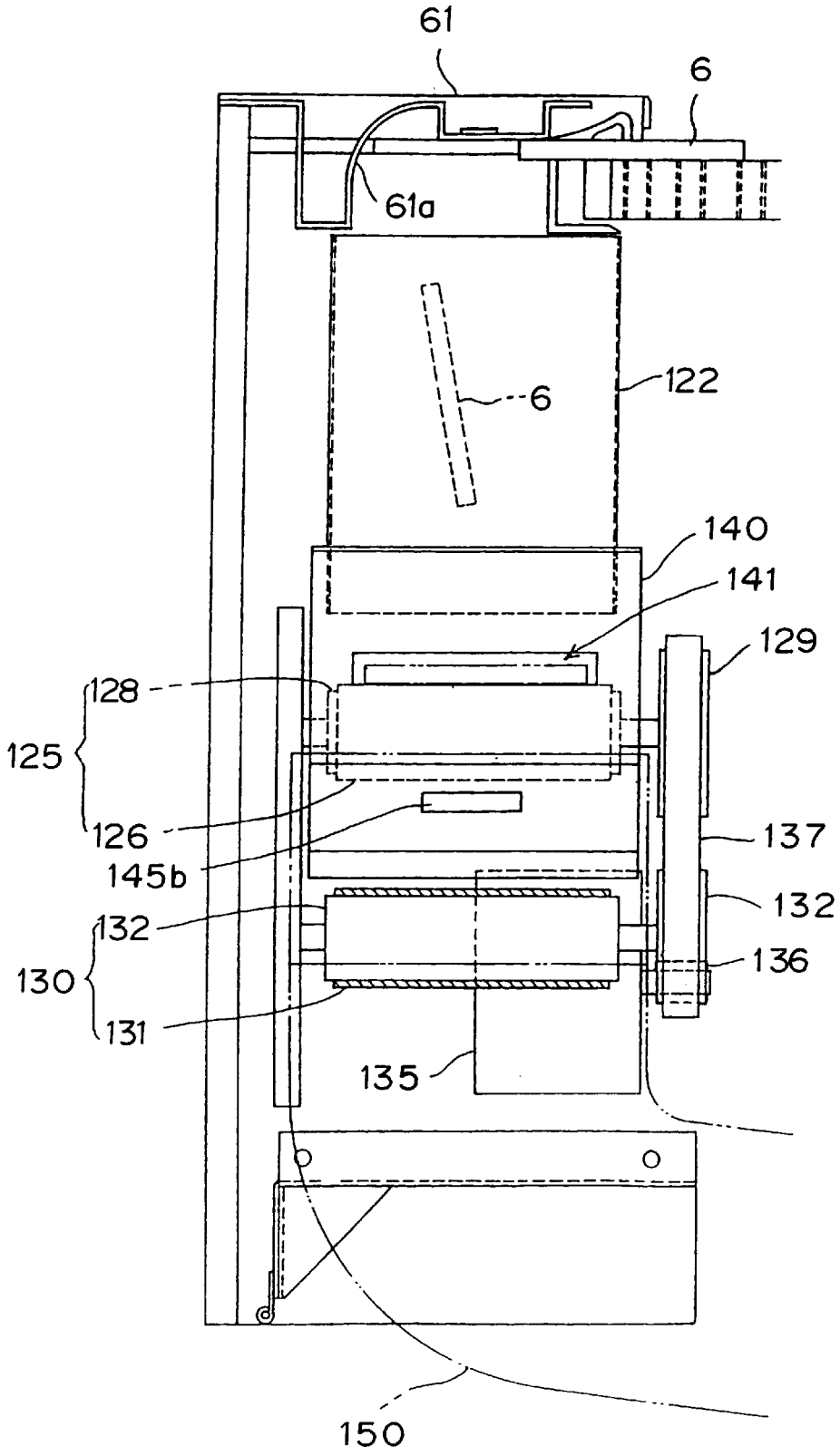
FIG. 11 is a front view viewed in the direction of the arrow XI of FIG. 10.

FIGS. 10 to 13 show another embodiment of the puck recovery mechanism 21. FIGS. 10 and 11 show the interior of the goal 8 where a cover plate 61 covers over the play field board 4 at a height allowing a piece of the puck 6 to pass and an opening having a width allowing two or three pieces of the puck 6 to pass at the same time is formed by cutting the frame rail 5.

As shown in FIG. 11, the cover plate 61 has a bent side wall 61*a* formed at the inner part of the goal for guiding downward and dropping the puck 6 entering through the goal opening. Under the cover plate 61 is positioned a square pipe 122 having upper and lower rectangular openings long in the front and rear direction. Front and rear side walls of the square pipe 122 have lower half portions inclined inwardly for directing the lower opening to a predetermined position (FIG. 10).

Under the lower opening of the square pipe 122 is disposed a conveyor belt 126 of an upper belt conveyor 125 wound round front and rear rolls 127, 128. Under the rear roll 128 is disposed a front roll 132 of a lower belt conveyor 130, and round the front roll 132 and a rear roll 133 of the conveyor 130 is wound a conveyor belt 131.

Under the upper belt conveyor 125 is disposed a driving motor 135. A driving pulley 136 fitted to a driving shaft of the driving motor 135, a driven pulley 129 coaxial with the rear roll 128 of the upper belt conveyor 125 and a driven pulley 134 coaxial with the front roll 132 of the lower belt conveyor 130 are projected so as to form the same vertical surface and a driving belt 137 is wound round these three pulleys 136, 129, 134.

The driven pulley 134 of the lower belt conveyor 130 has a diameter smaller than that of the driven pulley 129 of the upper belt conveyor 125. Therefore, when the upper belt conveyor 125 and the lower belt conveyor 130 are driven through the driving belt 137 by the driving motor 135, speed of the lower belt conveyor 130 is larger than that of the upper belt conveyor 125.

Figure 12:
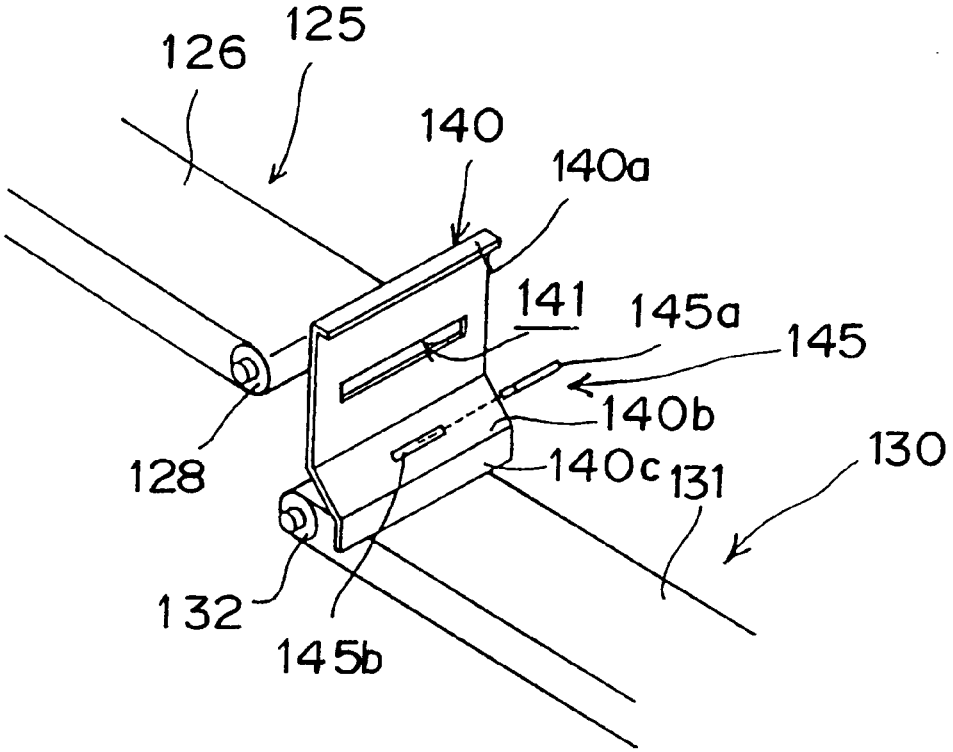
FIG. 12 is a perspective view of an essential part of the puck recovery mechanism.

A gate plate 140 is hung along a lower stream end of the upper belt conveyor 125. As shown in FIG. 12, the gate plate 140 has an upper half section 140*a* standing vertically and a lower half section comprising a inclined portion 140*b* bent rearward from the upper half section and a lower end portion 140*c* bent again to hang vertically.

The upper half section 140*a* is formed with a flat rectangular gate opening 141 at a position of the same height as the upper side of the conveyor belt 126 of the upper belt conveyor 125. The vertical and horizontal widths of the gate opening 141 are such that only one puck 6 coming transported by the conveyor belt 126 is allowed to pass.

Figure 13:
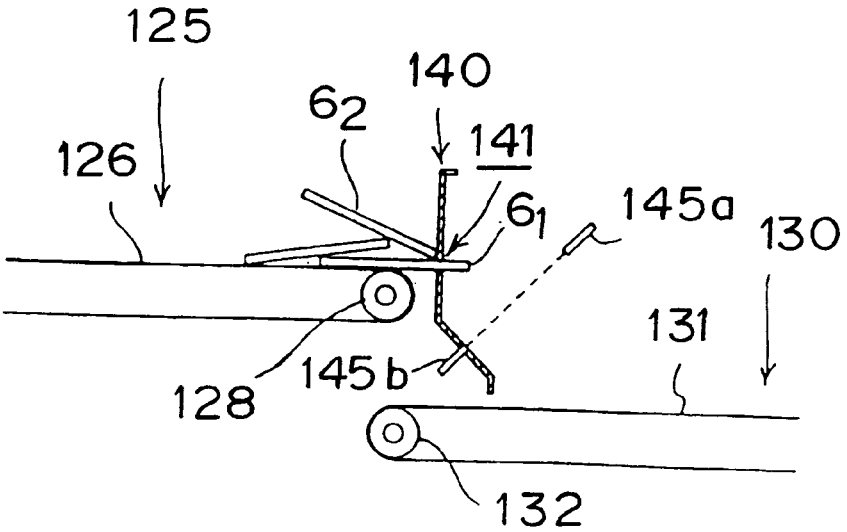
FIG. 13 is a side view thereof.

Therefore, when a plurality of pucks reach the gate plate 140 transported by the upper belt conveyor 125 in a heap as shown in FIG. 13, a lowermost puck $\mathbf{6}_1$ enters the gate openings 141 positioned at the same height as the puck $\mathbf{6}_1$, and a puck $\mathbf{6}_2$ placed on the puck $\mathbf{6}_1$ abuts against a part of the gate plate 140 above the gate opening 141 and stops. The puck $\mathbf{6}_2$ can pass through the gate opening 141 following the puck $\mathbf{6}_1$, provided that the puck $\mathbf{6}_2$ is placed directly on the conveyor belt 126 after the puck $\mathbf{6}_1$ passes through the gate opening 141.

In such a manner, even if a plurality of pucks 6 are transported in a heap, these pucks are taken out through the gate opening 141 one by one always.

The puck 6 taken out drops onto the lower belt conveyor 130. A light projector 145*a* and a light receiver 145*b* of a photo-sensor 145 is arranged so that a detection light streams across the dropping path of the puck 6. Therefore, the photo-sensor 145 detects the puck 6 running out of the gate opening 141 and dropping when the puck 6 interrupts the detection light projected from the light projector 145*a*.

The puck 6 dropped on the lower belt conveyor 130 is further transported rearward by the conveyor belt 131 and sent out to a recovery passage 150 which has an entrance 150*a* opening at a lower stream end of the lower belt conveyor 130. Since the speed of the lower belt conveyor 130 is higher than that of the upper belt conveyor 125, even if some pucks 6 drop onto the conveyor belt 131 successively, the preceding puck has been already transported by some distance by the conveyor belt 131 at the time when the succeeding puck drops on the conveyor belt 131 so that the pucks are transported leaving a predetermined or more space between them always.

Therefore, the pucks 6 are brought in the entrance 150*a* of the recovery passage 150 at regular intervals so that the pucks 6 are not jammed at the entrance 150*a* and can be brought in the recovery passage 150 smoothly.

The recovery passage 150 extends from the entrance 150*a* to the lower end of the main body section 20*a* of the automatic puck feeding device 20 slanting downward along the inner surface of the rear wall of the box body 3. The puck 6 rolls on the slanting recovery passage 150 by its own weight and reaches the lower end of the main body section 20*a* of the automatic puck feeding device 20.

The puck 6 reaching the lower end of the main body section 20*a* is lifted upward and fed again onto the play field board 4 through the guide passage 51, as stated above.

In the puck recovery mechanism having such a construction as mentioned above, the puck entering the opening of the goal 8 drops onto the upper belt conveyor 125 guided by the square pipe 122, passes through the gate opening 141 of the gate plate 140 to be dropped onto the lower belt conveyor 130 while detected by the photo-sensor 145, is transported rearward by the lower belt conveyor 130 at high speed to be brought in the recovery passage 150, and is recovered in the automatic puck feeding device 20 guided by the recovery passage 150.

In the above-mentioned air hockey game device, two or more pucks 6 can be fed onto the play field board 4 at the same time, and a game such that opposite players move a plurality of pucks 6 to shoot aiming a goal of an opponent and victory or defeat is decided by the number of reaching-goals can be carried out. The puck 6 reaching goal is detected by the photo-sensor 145 to increase score. The score is indicated on the aforementioned indication section 12.

When two or more pucks 6 are treated, sometimes a plurality of pucks 6 enter a goal 8 at the same time, or a plurality of pucks 6 are heaped up on the conveyor belt 126 of the upper belt conveyor 125. However, owing to the gate plate 140, the pucks 6 pass through the gate opening 141 and drops onto the lower belt conveyor 130 one by one surely so that the photo-sensor 145 can detect the pucks 6 one by one surely always.

The puck 6 dropped on the lower belt conveyor 130 is transported at the high speed and brought in the entrance 150*a* of the recovery passage 150, so that even if a plurality of pucks 6 reach goal, there is no fear that the pucks 6 are jammed at the entrance 150*a* of the recovery passage 150.

Since the puck 6 reaching goal is dropped, transported by the upper belt conveyor 125 forcibly, let pass through the gate opening 141 and detected by the photo-sensor 145, the time from an instant the puck reaches goal until the puck is detected is short and a new score can be indicated very soon, therefore, interest of the player is not spoiled.

INDUSTRIAL APPLICABILITY

The present invention can be utilized for a game device for playing a game simulating hockey, soccer or the like by moving a moving body levitated by air emitted in a state of small friction resistance.

We claim:

1. A game device for playing a game, said game device comprising:

a play field board;

a moving body levitated by air emitted from a number of holes formed in said play field board; and a moving body feeding device for automatically feeding said moving body onto said play field board, wherein said moving body feeding device comprises:

recovery means for recovering said moving body after use;

lifting means for lifting said moving body recovered by said recovery means above said play field board;

dropping means for dropping said moving body lifted by said lifting means; and guide means for guiding said moving body dropped by said dropping means onto said play field board.

2. A game device as claimed in claim 1, wherein said guide means has a discharge outlet positioned at a height near an upper surface of said play field board, thereby said dropped moving body is guided so as to run out horizontally onto said play field board when moving direction of said moving body is changed to about horizontal direction.

3. A game device as claimed in claim 2, wherein said play field board is shaped in a rectangle; goals are provided at right and left symmetrical positions of said play field board; said recovery means recovers said body after use entering said goal to a lower portion at a middle of a front or rear side edge of said play field board; and said lifting means, said dropping means and said guide means are arranged above said lower portion where said moving body is recovered by said recovery means.

4. A game device as claimed in claim 3, wherein a pair of said guide means are provided right and left, and said dropping means has distributing means for distributing said moving body lifted by said lifting means to any one of said right and left guide means.

5. A game device as claimed in any one of claims 2, 3 or 4, wherein said lifting means lifts a plurality of said moving bodies recovered by said recovery means continuously, and said dropping means drops said moving bodies lifted by said lifting means one by one.

6. A game device as claimed in claim 3, wherein an opening width adjustment means for adjusting width of an opening in said goal which said moving body enters is provided.

7. A game device claimed in claim 6, wherein an operation switch for instructing drive of said opening width adjustment means is provided.

8. A game device for playing a game, said game device comprising;

a rectangular shaped play field board;

a moving body levitated by air emitted from a number of holes formed in said play field board; and a moving body feeding device for automatically feeding said body onto said play field board, wherein goal openings are provided at right and left symmetrical positions of said play field board; and said moving body feeding device includes used moving body recovery means having a first conveyor provided under said goal opening, a gate provided at a take-out place of said first conveyor for letting said moving body pass one by one, and a detection means for detecting said moving body passing through said gate.

9. A game device as claimed in claim 8, wherein a second conveyor under said gate for receiving and transporting said moving body detected by said detection means, and a recovery passage having an upper stream end positioned under a carry-out place of said second conveyor and inclined for moving said moving body to a predetermined position are provided, and said second conveyor transports said moving body at a speed higher than that of said first conveyor.

10. A game device as claimed in claim 8, wherein said gate is a plate member standing at said carry-out place of said first conveyor and having an opening at the same height as said first conveyor for allowing one piece of said moving body to pass.

11. A game device as claimed in claim 8 or 9, wherein a frame rail is projected along circumference of said play field board and said goal openings are formed at right and left symmetrical positions of said frame rail.

12. A game device as claimed in claim 8 or 9 wherein said moving body is shaped in a disk.

13. A game device as claimed in claim 9, wherein said first and second conveyors are belt conveyors.

* * * * *